US007289901B2

(12) United States Patent
Kishibata et al.

(10) Patent No.: US 7,289,901 B2
(45) Date of Patent: Oct. 30, 2007

(54) VEHICLE-MOUNTED POWER GENERATOR SET

(75) Inventors: Kazuyoshi Kishibata, Numazu (JP); Masahiko Endou, Numazu (JP); Tomoaki Sekita, Numazu (JP)

(73) Assignee: Kokusan Denki Co., Ltd., Shizuoka-Ken (JP)

( * ) Notice: Subject to any disclaimer, the term of this patent is extended or adjusted under 35 U.S.C. 154(b) by 184 days.

(21) Appl. No.: 11/269,325

(22) Filed: Nov. 8, 2005

(65) Prior Publication Data

US 2006/0103239 A1 May 18, 2006

(30) Foreign Application Priority Data

Nov. 12, 2004 (JP) ..... 2004-328636

(51) Int. Cl.
*F02D 41/22* (2006.01)
*F02P 11/00* (2006.01)

(52) U.S. Cl. ..... 701/107; 701/110; 307/10.1

(58) Field of Classification Search ..... 701/107, 701/101, 102, 103, 110, 112, 114, 115; 123/333, 123/335, 399, 406.13, 406.25, 406.35, 406.58; 290/40 B, 40 C, 40 R, 51; 477/84, 91; 180/65.2, 180/65.3, 65.4; 307/10.1, 10.3; 361/21
See application file for complete search history.

(56) References Cited

U.S. PATENT DOCUMENTS 5,864,770 A * 1/1999 Ziph et al. ..... 701/110
6,394,206 B1 * 5/2002 Fury ..... 180/53.4
6,947,827 B2 * 9/2005 Fuse et al. ..... 701/110
7,200,484 B2 * 4/2007 Yasui et al. ..... 701/103

FOREIGN PATENT DOCUMENTS

JP 2004-092634 3/2004
JP 2004-104854 4/2004

* cited by examiner

*Primary Examiner*—Willis R. Wolte
*Assistant Examiner*—Johnny H. Hoang
(74) *Attorney, Agent, or Firm*—Pearne & Gordon LLP

(57) ABSTRACT

A vehicle-mounted power generator set including: an AC generator driven by an engine of a vehicle; an electric power conversion portion that converts an output of the AC generator into an AC output having commercial frequency; a controller having electric power conversion portion control means for controlling the conversion portion to generate an AC output having commercial frequency when a control mode is a power generation mode, and engine control means for controlling the engine to rotate at a rotational speed suitable for supplying electric power from the conversion portion to a load when the control mode is the power generation mode and controlling the engine to be suitable for driving the vehicle when the control mode is the vehicle driving mode; and a control switch inserted between each output terminal of the AC generator and each input terminal of the electric power conversion portion, and controlled to be in an ON state when the control mode is the power generation mode and in an OFF state when the control mode is the vehicle driving mode.

8 Claims, 6 Drawing Sheets

VEHICLE-MOUNTED POWER GENERATOR SET

TECHNICAL FIELD OF THE INVENTION

The present invention relates to a power generator set mounted in a vehicle.

BACKGROUND OF THE INVENTION

As disclosed in Japanese Patent Application Laid-Open Publication No. 2004-92634, engine driven vehicles such as ATVs (All Terrain Vehicles, so-called buggies), tractors, or recreation vehicles that are vehicles intended mainly for driving on rough ground have been incorporating a power generator set driven by an engine for driving a vehicle to supply commercial AC electric power of AC 100 V or AC 200 V (50 Hz or 60 Hz), or the like to an external electrical load such as an electric tool or a home appliance while the vehicle is stopped, in order to allow the external electrical load to be used outdoors.

As known, a vehicle-mounted power generator set is comprised of an AC generator driven by an engine and an electric power conversion portion that converts an output voltage of the AC generator into an AC voltage having a fixed frequency (generally, commercial frequency). An electric power conversion portion comprised of a converter that converts an output of the AC generator into a DC output and an inverter that converts the DC output from the converter into an AC output having commercial frequency, or an electric power conversion portion comprised of a cyclone converter that directly converts an output of the AC generator into an AC output having commercial frequency is used.

In such a power generator set, even if a rotational speed of a generator is changed, an AC output having a fixed frequency can be obtained, and thus the rotational speed of the generator can be freely changed. When a load is light, the rotational speed of the engine can be reduced to improve specific fuel consumption (efficiency), and when the load is heavy, the rotational speed of the engine can be increased to increase the amount of electric power generated. Thus, a high output can be obtained without having a very large generator. Also, the amount of electric power generated can be controlled according to the rotational speed of the engine, and thus a magnetic AC generator that cannot control a magnetic field can be used as a generator for supplying electric power to an external electrical load. The magnetic AC generator is widely used as a generator for supplying electric power to various electrical components (an ignition device of an engine, a fuel injection device, a controller for controlling the ignition device and the fuel injection device, or the like) provided in a vehicle body. A vehicle-mounted power generator set for supplying electric power to an external load can be easily comprised by providing an armature winding for supplying electric power to the external load to the magnetic AC generator.

In the vehicle-mounted power generator set, a control mode of the engine is switched from a vehicle driving mode to a power generation mode by a mode selection switch when the vehicle is stopped and a gear position of a power transmission device is in a position for cutting power transmission (a neutral position or a parking position). When the control mode of the engine is switched to the power generation mode, the controller increases the rotational speed of the engine and controls the rotational speed of the engine at a rotational speed suitable for the external electrical load.

The vehicle-mounted power generator set that supplies electric power to the external electrical load while the vehicle is stopped is maintained in a no-load state while the vehicle is driving. Thus, if the magnetic AC generator is used as the generator, a high no-load voltage is induced in an armature coil in the generator when the rotational speed of the engine increases while the vehicle is driving. The no-load induced voltage is applied to the electric power conversion portion, and may damage circuit elements that constitute the electric power conversion portion.

Thus, as disclosed in Japanese Patent Application Laid-Open Publication No. 2004-104854, as a vehicle-mounted power generator set, an inverter controlled power generator set has been proposed including means for preventing a magnetic AC generator from generating a high no-load induced voltage when a rotational speed of an engine increases while a vehicle is driving. The power generator set disclosed in Japanese Patent Application Laid-Open Publication No. 2004-104854 includes a load resistance connected across output terminals of the magnetic AC generator via switch means, and control means for controlling to maintain the switch means in an OFF state when an output voltage of the generator is less than a set value, and switch the switch means to an ON state when the output voltage of the generator exceeds the set value.

Comprised as described above, when the rotational speed of the engine increases while the vehicle is driving and the output voltage of the generator increases, the load resistance can be connected across the output terminals of the generator to pass a current from the generator through the load resistance, thereby reducing the output voltage of the generator and preventing an overvoltage from being applied to the electric power conversion portion.

For the power generator set in Japanese Patent Application Laid-Open Publication No. 2004-104854, when the rotational speed of the engine increases while the vehicle is driving, the current passes from the generator through the load resistance and electric power is wasted in the load resistance. This may increase the load of the engine when the engine rotates at a high speed, thereby reducing an engine output provided to drive wheels of the vehicle or reducing fuel economy.

SUMMARY OF THE INVENTION

An object of the present invention is to provide a vehicle-mounted power generator set that can prevent an overvoltage from being applied to an electric power conversion portion without reducing an engine output or fuel economy when a rotational speed of an engine increases while a vehicle is driving.

The present invention is applied to a vehicle-mounted power generator set including: an AC generator mounted in a vehicle and driven by an engine which drives the vehicle; an electric power conversion portion that converts an output of the AC generator into an AC output having commercial frequency; a mode selection switch that is operated to be in different states between when a control mode is a power generation mode and when the control mode is a vehicle driving mode; and a controller having electric power conversion portion control means for controlling the electric power conversion portion to generate an AC output having a fixed frequency from the electric power conversion portion when the control mode is the power generation mode, and engine control means for controlling the engine to rotate at a rotational speed suitable for supplying electric power from the electric power conversion portion to a load when the control mode is the power generation mode and controlling the engine to be suitable for driving of the vehicle when the control mode is the vehicle driving mode.

In the present invention, a power generation output supply control switch that is turned on/off in synchronization with the mode selection switch to be in an ON state when the control mode is the power generation mode and in an OFF state when the control mode is the vehicle driving mode is inserted between each output terminal of the AC generator and each input terminal of a converter.

Comprised as described above, the electric power conversion portion is disconnected from the AC generator when the engine is controlled in the vehicle driving mode, thereby preventing an overvoltage from being applied from the AC generator to the electric power conversion portion to damage circuit elements that constitute the electric power conversion portion when the rotational speed of the engine increases while the vehicle is driving.

In a preferable aspect of the present invention, the controller includes overspeed protection control means for controlling to stop at least either an ignition operation of the engine or supply of fuel to the engine when the rotational speed of the engine exceeds a predetermined set speed with the control mode being switched to the power generation mode to limit the rotational speed of the engine to the set speed or less in order to prevent the overvoltage from being applied from the AC generator to the electric power conversion portion.

Providing the overspeed protection control means prevents the rotational speed of the engine from exceeding the set speed to apply the overvoltage from the AC generator to the electric power conversion portion when a driver inadvertently operates an accelerator to open a throttle valve or when a load of a power generator set is suddenly reduced while the engine is operated in the power generation mode.

In a preferable aspect of the present invention, the controller includes overvoltage protection control means for controlling to stop at least either an ignition operation of the engine or supply of fuel to the engine when an output voltage of the AC generator exceeds a predetermined set voltage with the control mode being switched to the power generation mode to reduce the rotational speed of the engine and limit the output voltage of the AC generator to the set voltage or less in order to prevent the overvoltage from being applied from the AC generator to the electric power conversion portion.

Also comprised as described above, the rotational speed of the engine is prevented from increasing to apply the overvoltage from the AC generator to the electric power conversion portion when the driver inadvertently operates the accelerator to open the throttle valve or when the load of the power generator set is suddenly reduced while the engine is operated in the power generation mode.

In another preferable aspect of the present invention, an electromagnetic relay is provided having a contact inserted between each output terminal of the AC generator and each input terminal of the converter, and the controller includes relay control means for controlling the electromagnetic relay according to the state of the mode selection switch so that each contact of the electromagnetic relay is in an ON state when the control modes is the power generation mode and in an OFF state when the control mode is the vehicle driving mode.

Comprised as described above, the electric power conversion portion is disconnected from the AC generator when the engine is controlled in the vehicle driving mode, thereby preventing the overvoltage from being applied from the AC generator to the electric power conversion portion to damage circuit elements that constitute the electric power conversion portion when the rotational speed of the engine increases while the vehicle is driving.

In the case of using the electromagnetic relay as described above, the controller preferably includes overvoltage protection relay control means for controlling to open the contact of the electromagnetic relay when the rotational speed of the engine exceeds a predetermined set speed with the control mode being switched to the power generation mode in order to prevent the overvoltage from being applied from the AC generator to the electric power conversion portion, or overvoltage protection relay control means for controlling to open the contact of the electromagnetic relay when an output voltage of the generator exceeds a predetermined set voltage with the control mode being switched to the power generation mode in order to prevent the overvoltage from being applied from the AC generator to the electric power conversion portion.

Also comprised as described above, the rotational speed of the engine is prevented from exceeding the set speed to apply the overvoltage from the AC generator to the electric power conversion portion when the driver inadvertently operates the accelerator to open the throttle valve or when the load of the power generator set is suddenly reduced while the engine is controlled in the power generation mode.

Also when the contact of the electromagnetic relay is inserted between the AC generator and the converter, the controller preferably includes overspeed protection control means for controlling to stop at least either an ignition operation of the engine or supply of fuel to the engine when the rotational speed of the engine exceeds a predetermined set speed with the control mode being switched to the power generation mode to limit the rotational speed of the engine to the set speed or less in order to prevent the overvoltage from being applied from the AC generator to the electric power conversion portion, or overvoltage protection control means for controlling to stop at least either an ignition operation of the engine or supply of fuel to the engine when an output voltage of the AC generator exceeds a predetermined set voltage with the control mode being switched to the power generation mode to reduce the rotational speed of the engine and limit the output voltage of the AC generator to the set voltage or less in order to prevent the overvoltage from being applied from the AC generator to the electric power conversion portion.

Also comprised as described above, the rotational speed of the engine is prevented from increasing to apply the overvoltage from the AC generator to the electric power conversion portion when the driver inadvertently operates the accelerator to open the throttle valve or when the load of the power generator set is suddenly reduced while the engine is controlled in the power generation mode.

As described above, according to the present invention, the power generation output supply control switch interlocked with the mode selection switch is inserted between the AC generator and the electric power conversion portion, and opened when the engine is controlled in the vehicle driving mode to disconnect the electric power conversion portion from the AC generator. This prevents the overvoltage from being applied from the AC generator to the electric power conversion portion to damage circuit elements that constitute the electric power conversion portion when the rotational speed of the engine increases while the vehicle is driving.

In the present invention, if control is performed to stop at least either the ignition operation of the engine or the supply of the fuel to the engine when the rotational speed of the engine exceeds the predetermined set speed or when the output voltage of the generator exceeds the set voltage with the control mode being switched to the power generation mode to limit the rotational speed of the engine to the set speed or less, the overvoltage is prevented from being applied from the AC generator to the electric power conversion portion to damage the circuit elements that constitute the electric power conversion portion when the driver inadvertently operates the accelerator to increase the rotational speed of the engine or when the load of the power generator set is suddenly reduced to increase the rotational speed of the engine while the engine is controlled in the power generation mode.

BRIEF DESCRIPTION OF THE DRAWINGS

The above and other objects and features of the invention will be apparent from the detailed description of the preferred embodiments of the invention, which are described and illustrated with reference to the accompanying drawings, in which.

DETAILED DESCRIPTION OF THE PREFERRED EMBODIMENTS

Now, preferred embodiments of the present invention will be described with reference to the drawings.

Figure 1:
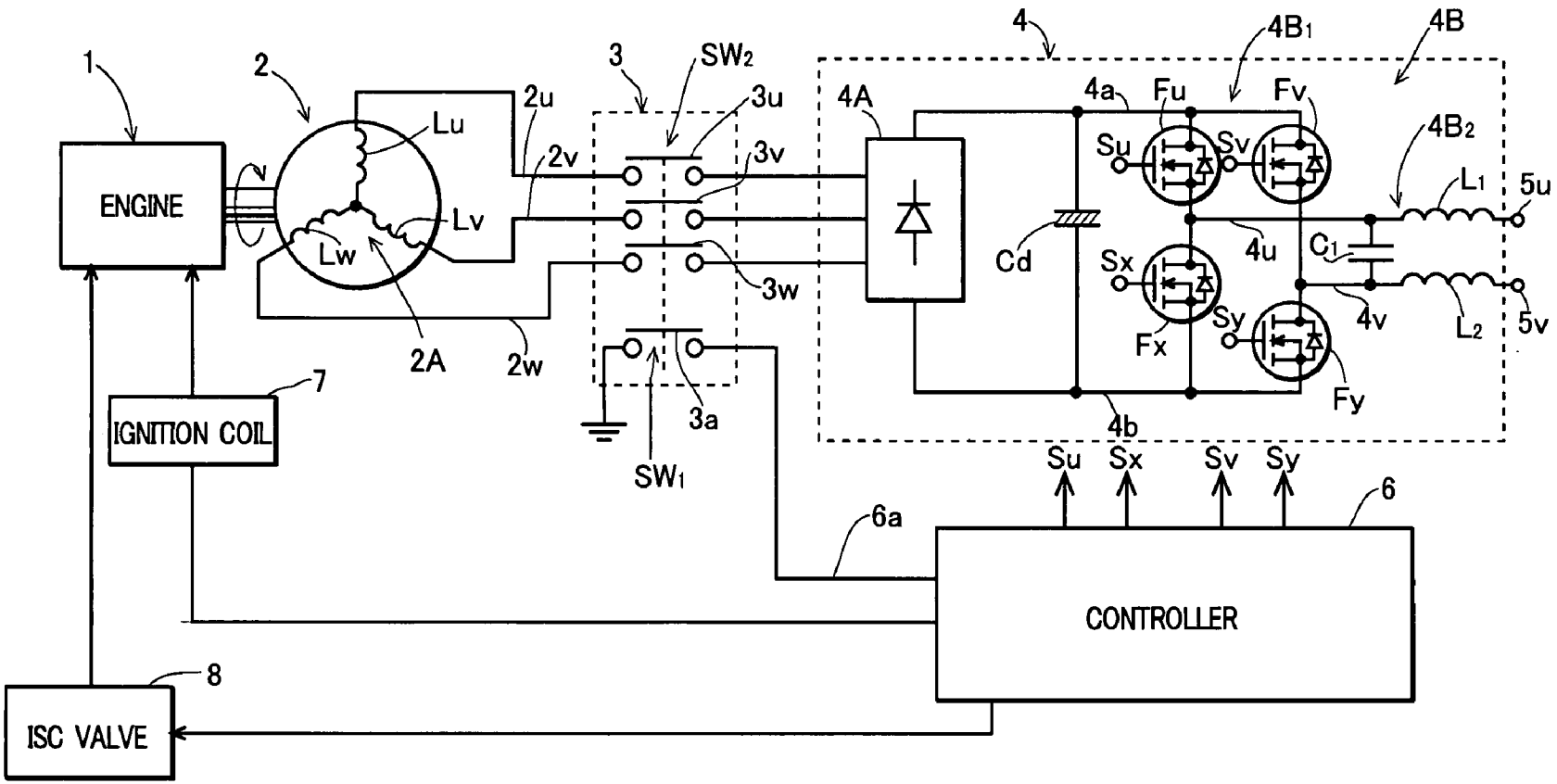
FIG. 1 is a circuit diagram of a construction of an embodiment of the present invention.

FIG. 1 is a circuit diagram of a construction of a first embodiment of the present invention. In FIG. 1, a reference numeral 1 denotes an engine for driving a vehicle, and 2 denotes a magnetic AC generator driven by the engine 1. The AC generator 2 has an armature winding (not shown) that supplies electric power to electrical components of the vehicle, and an armature winding 2A comprised of coils Lu to Lw three-phase star connected. Output terminals 2*u* to 2*w* of the generator 2 are drawn from ends opposite to a neutral point of the coils Lu to Lw, and a three-phase AC output obtained across the output terminals is input to an electric power conversion portion 4 via a switch 3.

In the shown example, the electric power conversion portion 4 is comprised of a converter 4A that converts an AC output of the AC generator 2 into a DC output, a smoothing capacitor Cd connected across output terminals of the converter 4A, and an inverter 4B having a function of converting the DC output of the converter 4A into an AC voltage.

The converter 4A is generally comprised of a diode bridge full-wave rectifier circuit, and the inverter 4B is comprised of an H-bridge type switch circuit 4B1 with sides of a bridge being comprised of switch elements, and a filter circuit 4B2. In the shown example, the H-bridge type switch circuit 4B1 is comprised of N-channel type MOSFETs Fu and Fv having drains connected in common, and N-channel type MOSFETs Fx and Fy having drains connected to sources of the MOSFETs Fu and Fv and sources connected in common. In this switch circuit, a common connection point of the drains of the MOSFETs Fu and Fv and a common connection point of the sources of the MOSFETs Fx and Fy are DC input terminals 4*a* and 4*b*, and the output voltage of the converter 4A is applied across the DC input terminals. Connection points of the sources of the MOSFETs Fu and Fv and the drains of the MOSFETs Fx and Fy are AC output terminals 4*u* and 4*v*, and an AC output obtained across the AC output terminals is input to the filter circuit 4B2.

The switch circuit 4B1 is controlled by a controller 6 to output an AC voltage having commercial frequency (50 Hz or 60 Hz) across the output terminals 4*u* and 4*v*.

The filter circuit 4B2 is a low pass filter comprised of coils L1 and L2 and a capacitor C1, removes harmonic contents from the AC voltage output from the switch circuit 4B1, and outputs a voltage only of commercial AC frequency contents across load connection terminals 5*u* and 5*v*.

The controller 6 includes a microprocessor, an ignition circuit that controls a primary current of an ignition coil that provides a high voltage to an ignition plug mounted to a cylinder of the engine 1, an injector drive circuit that drives an injector of a fuel injection device that supplies fuel to the engine 1, and an ISC valve drive circuit that drives an ISC valve 8 that adjusts the amount of air flowing through an air passage provided to bypass a throttle valve of the engine, and controls an ignition timing and a fuel injection amount of the engine 1 and the inverter 4B. The ISC valve 8 has a solenoid, and PWM control of a current passed through the solenoid allows an opening degree of the ISC valve 8 to be adjusted.

The switch 3 used in the embodiment is comprised of a multipolar switch having contacts, the number of which is one added to the number of phases (three in the example) of the generator 2 and in which all the contacts are collectively operated. The shown switch 3 is comprised of a manual four-polarity switch having four contacts 3*u*, 3*v*, 3*w* and 3*a*, and unshown operation portions (knobs or push buttons) are manually operated to turn on/off the contacts 3*u*, 3*v*, 3*w* and 3*a* at the same time at the same phase. In the embodiment, among the contacts provided in the switch 3, one contact 3*a* that is not connected to the generator is used as a mode selection switch SW1. One end of the contact 3*a* that constitutes the mode selection switch is grounded, and the other end thereof is connected to a mode selection signal input terminal 6*a* of the controller 6. The mode selection switch SW1 is a switch that is operated to be in different states between when a control mode of the engine is a power generation mode and when the control mode is a vehicle driving mode. The mode selection switch SW1 according to the embodiment is switched to an ON state when the control mode of the engine is the power generation mode and to an OFF state when the control mode of the engine is the vehicle driving mode.

The contacts 3*u* and 3*w* of the switch 3 are inserted between the three-phase output terminals 2*u* to 2*w* of the AC generator 2 and the three-phase input terminals of the electric power conversion portion 4 (the three-phase input terminals of the converter 4A in the shown example), respectively, and a power generation output supply control switch SW2 is comprised of the contacts 3*u* to 3*w*. The power generation output supply control switch SW2 is turned on/off in synchronization with the mode selection switch SW1 so as to be in the ON state when the control mode is the power generation mode and in the OFF state when the control mode is the vehicle driving mode.

Figure 2:
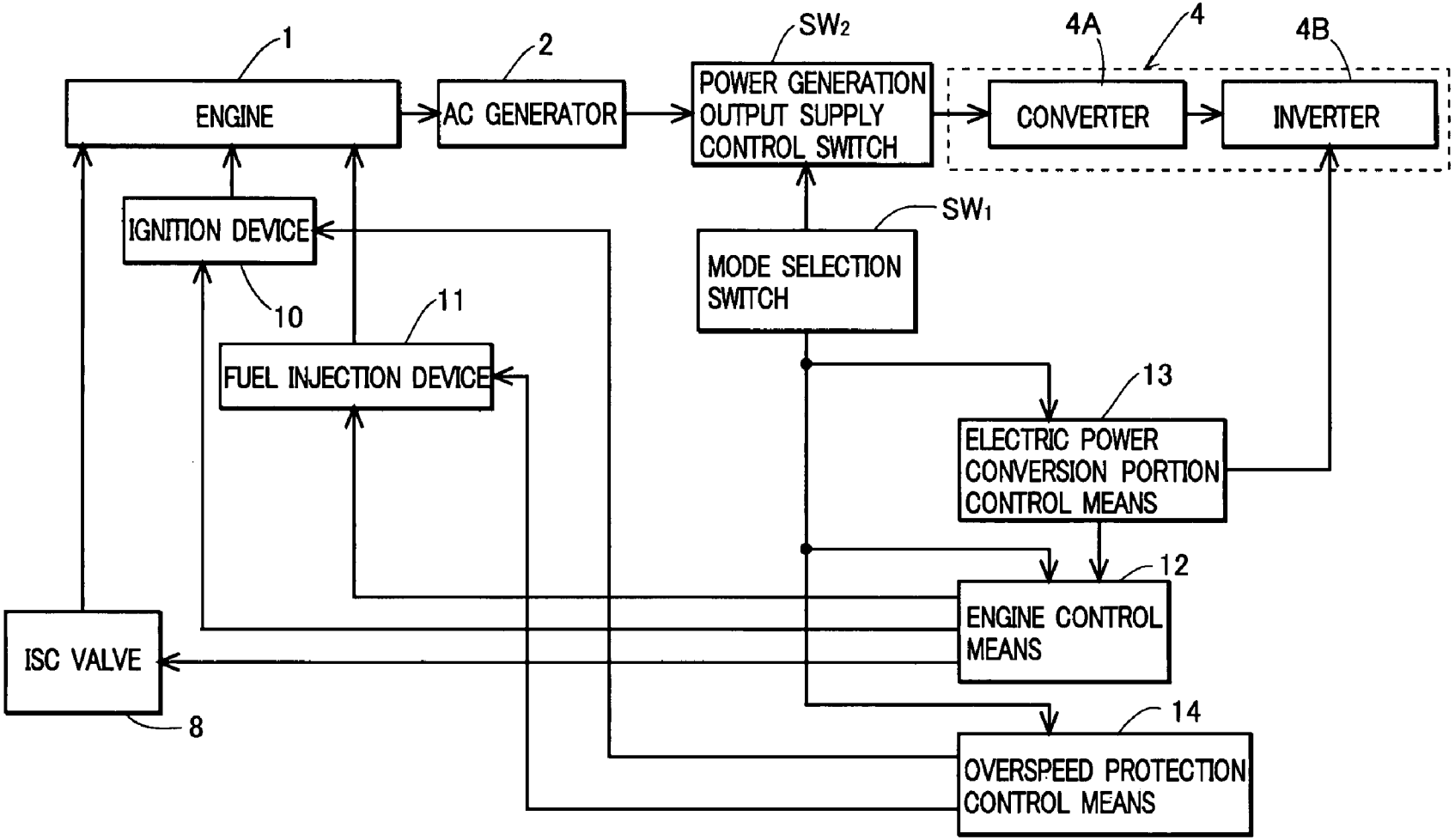
FIG. 2 is a block diagram of an example of an electrical construction of a power generator set including control means comprised by a microprocessor of a controller in the embodiment in FIG. 1.

Various control means are comprised by the microprocessor of the controller 6 executing a predetermined program. An electrical construction of a power generator set in FIG. 1 including various control means comprised by the microprocessor of the controller is shown in FIG. 2. In FIG. 2, a reference numeral 10 denotes an ignition device that ignites the engine 1, and the ignition device is comprised of an ignition circuit provided in the controller 6 and the ignition coil 7 shown in FIG. 1. The ignition device 10 causes a sudden change in a primary current of the ignition coil when an ignition signal is provided from the engine control means to induce a high voltage for ignition in a secondary coil of the ignition coil 7.

A reference numeral 11 denotes a fuel injection device that supplies fuel to the engine 1, and the fuel injection device is comprised of an injector (an electromagnetic fuel injection valve) mounted to an intake pipe of the engine, an injector drive circuit (generally provided in the controller 6) that supplies a drive current to the injector, a fuel pump that supplies fuel to the injector, and a pressure regulator that controls to maintain a pressure of the fuel provided from the fuel pump to the injector at a constant level. The pressure of the fuel provided to the injector is maintained at the constant level and thus the fuel injection amount is controlled according to time for injecting the fuel from the injector (a fuel injection time).

A reference numeral 12 denotes engine control means, 13 denotes electric power conversion portion control means, 14 denotes overspeed protection control means, and these control means are comprised by the microprocessor of the controller 6 executing predetermined programs.

The engine control means 12 controls the engine 1 to rotate at a rotational speed suitable for supplying power from the electric power conversion portion 4 to a load when the control mode is switched to the power generation mode by the mode selection switch SW1, and controls the engine 1 to be suitable for driving of the vehicle when the control mode is the vehicle driving mode.

The engine control means 12 is comprised of ignition control means for arithmetically operating an ignition timing of the engine with respect to the rotational speed of the engine and providing the ignition signal to the ignition device 10 when the arithmetically operated ignition timing is detected, injection control means for arithmetically operating a fuel injection time under control conditions such as the rotational speed of the engine, engine temperature, intake air temperature, atmospheric pressure, an opening degree of the throttle valve and providing an injection instruction signal having a signal width corresponding to the arithmetically operated injection time to the injector drive circuit of the fuel injection device 11 when a predetermined injection start timing is detected, and ISC valve control means for controlling the ISC valve 8 to match the rotational speed of the engine with a target rotational speed in the power generation mode, and controlling the ISC valve 8 to maintain an idle rotational speed at a target speed in idling of the engine in the vehicle driving mode. The target rotational speed of the engine in the power generation mode is a rotational speed of the engine required for generating a predetermined output from the inverter 4B, and provided from the electric power conversion portion control means 13.

The electric power conversion portion control means 13 controls the switch circuit 4B1 of the inverter 4B so that the electric power conversion portion 4 generates the AC output having a fixed frequency when the control mode is switched to the power generation mode by the mode selection switch SW1, and arithmetically operating the target rotational speed of the engine required for maintaining the output voltage of the electric power conversion portion 4 at a target voltage to provide the target rotational speed to the engine control means 12.

The overspeed protection control means 14 controls to stop at least either an ignition operation of the engine 1 or the supply of the fuel to the engine when the rotational speed of the engine 1 exceeds a predetermined set speed with the control mode being switched to the power generation mode to limit the rotational speed of the engine 1 to the set speed or less in order to prevent an overvoltage from being applied from the AC generator 2 to the electric power conversion portion 4. The rotational speed of the engine 1 is calculated by an arithmetical operation from a generation interval of pulse signals obtained by a pulse signal generator (not shown) that generates a pulse signal when a crank angle position of the engine matches a set position.

The overspeed protection control means 14 repeats a control operation to stop at least either the ignition operation of the ignition device 10 or a fuel injection operation of the fuel injection device 11 when the rotational speed of the engine exceeds the set speed with the control mode being switched to the power generation mode by the mode selection switch SW1 to reduce the rotational speed of the engine, and to restore the ignition operation and the fuel injection operation when the rotational speed of the engine reaches a return speed or less set slightly lower than the set speed to maintain the rotation of the engine, and thus controls the rotational speed of the engine 1 at the set speed or less. Controlling the rotational speed of the engine at the set speed or less by such a method per se is known. The set speed of the engine is set slightly lower than the rotational speed of the engine when a peek value of the output voltage of the generator 2 exceeds the withstand voltage of semiconductor elements that constitute the electric power conversion portion 4.

In the power generator set according to the above embodiment, when electric power is supplied from the inverter 4B to an external electrical load, the vehicle is stopped, and a gear position of a power transmission device provided between the engine 1 and drive wheels of the vehicle is set to a position for cutting power transmission (for example, a parking position), and the mode selection switch SW1 is turned on to switch the control mode to the power generation mode. At this time, the contacts 3*u*, 3*v*, and 3*w* that constitute the power generation output supply control switch SW2 are turned on.

When the mode selection switch SW1 is turned on, a mode selection signal input terminal 6*a* of the controller 6 is grounded. Thus, the microprocessor of the controller recognizes that the power generation mode is selected to switch the control mode to the power generation mode, provides drive signals (signals for turning on the MOSFETs) Su, Sv, Sx and Sy to the MOSFETs Fu, Fv, Fx and Fy of the switch circuit 4B1 at predetermined timings so that the electric power conversion portion control means 13 comprised by the microprocessor outputs an AC voltage having predetermined commercial frequency from the inverter 4B, and performs PWM modulation of a drive signal provided to a MOSFET at an upper side or a lower side of the bridge of the switch circuit 4B1 so that the signal has a waveform that is interrupted at a predetermined duty ratio to output a sinusoidal AC voltage from the inverter 4B. The controller also detects the output voltage of the inverter 4B, arithmetically operates the target rotational speed of the engine required for maintaining the detected output voltage at the target value (a rated value), and provides the arithmetically operated target rotational speed to the engine control means 12. The engine control means 12 controls the opening degree of the ISC valve 8 so that a deviation between the rotational speed of the engine 1 and the target rotational speed is zero to maintain the rotational speed of the engine at the target rotational speed.

If a driver inadvertently operates an accelerator to open the throttle valve of the engine or when a load of the power generator set is suddenly reduced while the engine is operated in the power generation mode, the rotational speed of the engine increases above the target rotational speed. Thus, the output voltage of the generator 2 increases, and the peek value of the output voltage may exceed the withstand voltage of the circuit elements that constitute the electric power conversion portion 4. Thus, in the embodiment, the overspeed protection control means 14 is provided for controlling to stop at least either the ignition operation of the engine or the supply of the fuel to the engine when the rotational speed of the engine 1 exceeds the predetermined set speed with the control mode being switched to the power generation mode to limit the rotational speed of the engine to the set speed or less.

Providing the overspeed protection control means 14 prevents an overvoltage from being applied from the generator 2 to the electric power conversion portion 4 when the driver inadvertently operates the accelerator or when the load of the power generator set is suddenly reduced while the engine is operated in the power generation mode, thereby preventing components of the electric power conversion portion from being damaged by the overvoltage.

When the mode selection switch SW1 is opened to switch the control mode to the vehicle driving mode, the power generation output supply control switch SW2 is opened. Thus, even if the rotational speed of the generator 2 increases and the armature winding 2A generates a high voltage while the vehicle is driving at a high speed or the like, the high voltage is not applied to the electric power conversion portion 4. Thus, even if the rotational speed of the engine increases and the generator generates the high voltage while the vehicle is driving, no components of the electric power conversion portion 4 are damaged.

Figure 3:
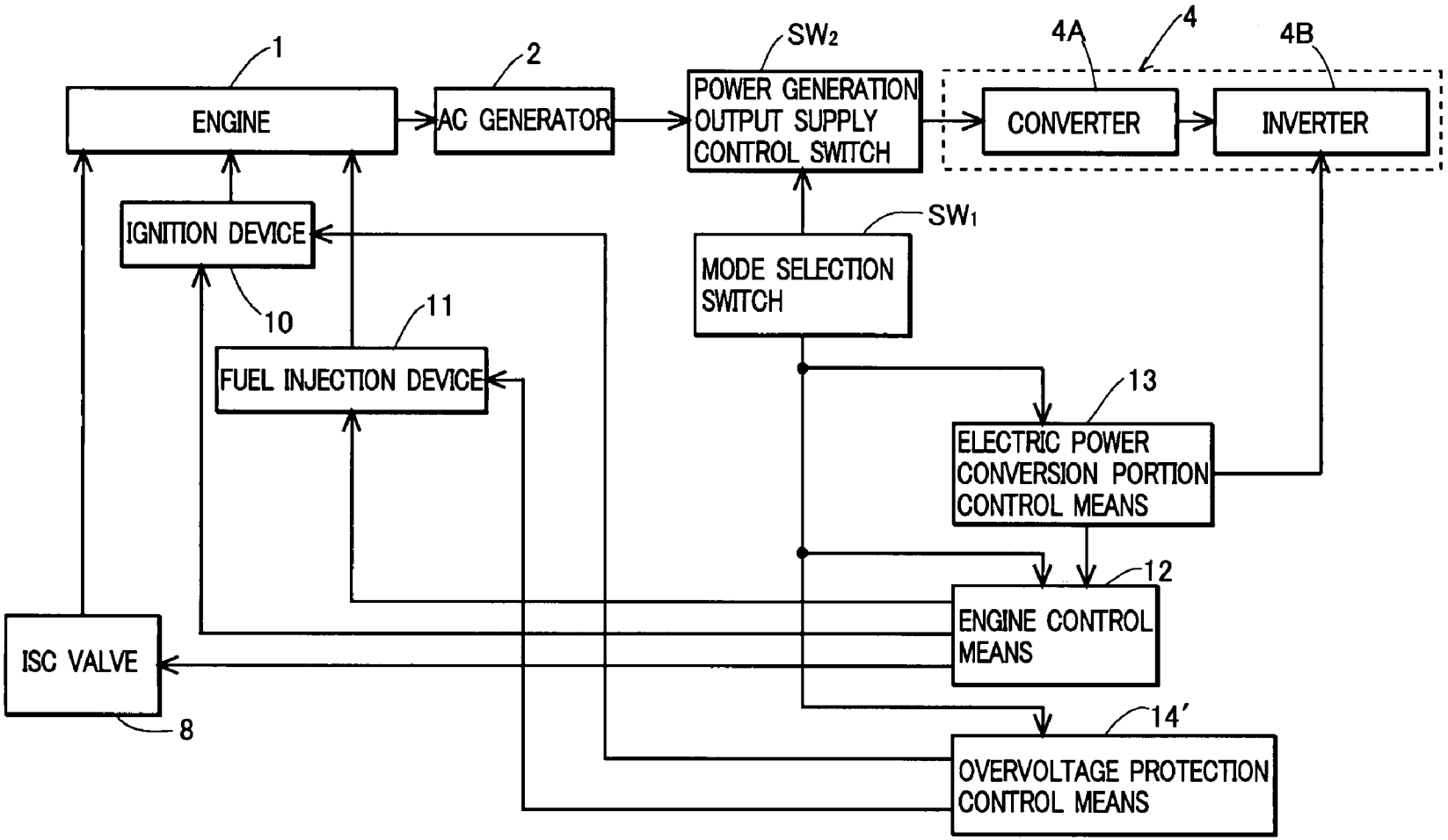
FIG. 3 is a block diagram of another example of an electrical construction of a power generator set including control means comprised by the microprocessor of the controller in the embodiment in FIG. 1.

In the above embodiment, the overspeed protection control means 14 is provided for controlling to stop at least either the ignition operation of the engine 1 or the supply of the fuel to the engine when the rotational speed of the engine exceeds the predetermined set speed with the control mode being switched to the power generation mode to limit the rotational speed of the engine to the set speed or less in order to prevent the overvoltage from being applied from the generator 2 to the electric power conversion portion 4. As shown in FIG. 3, however, overvoltage protection control means 14' may be provided for controlling to stop at least either the ignition operation of the engine or the supply of the fuel to the engine when the output voltage of the AC generator 2 exceeds a predetermined set voltage with the control mode being switched to the power generation mode to reduce the rotational speed of the engine and limit the output voltage of the AC generator to the set voltage or less in order to prevent the overvoltage from being applied from the AC generator 2 to the electric power conversion portion 4.

In the above embodiment, the AC generator is comprised so as to generate a three-phase output, and thus the four-polarity switch is used as the switch 3, but when a single-phase magnetic AC generator is used, a three-polarity switch having two contacts that constitute a power generation output supply control switch and one contact that constitutes a mode selection switch SW1 may be used.

Figure 4:
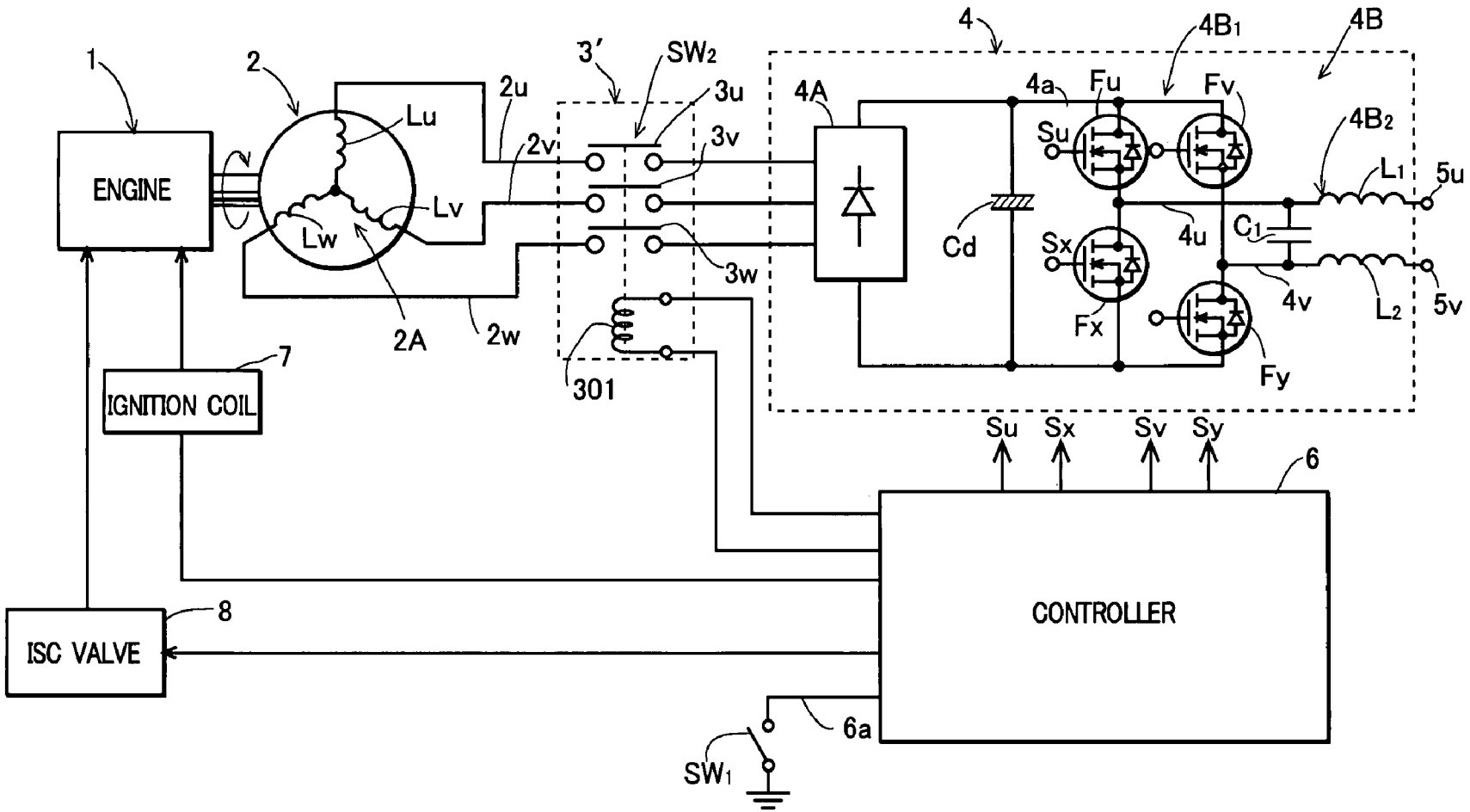
FIG. 4 is a circuit diagram of a construction of another embodiment of the present invention.

In each embodiment, the manual switch that constitutes the power generation output supply control switch SW2 inserted between the AC generator and the converter 4A incorporates the contact that constitutes the mode selection switch so that the mode selection switch SW1 and the power generation output supply control switch SW2 are turned on/off in synchronization with each other. As shown in FIG. 4, however, an power generation output supply control switch SW2 inserted between an AC generator 2 and a converter 4A may be comprised of an electromagnetic relay 3', and a manual mode selection switch SW1 may be separately provided and connected between a mode selection signal input terminal 6*a* of a controller 6 and the ground. An electrical construction of a power generator set when comprised as in FIG. 4 is shown in FIG. 5.

The shown electromagnetic relay 3' is comprised of an excitation coil 301, and contacts 3*u*, 3*v* and 3*w* that are turned on when the excitation coil 301 is excited, and the contacts 3*u*, 3*v* and 3*w* are inserted between three-phase output terminals 2*u*, 2*v* and 2*w* of the AC generator 2 and three-phase input terminals of a converter 4A. The power generation output supply control switch SW2 is comprised of the contacts 3*u* to 3*w*. The excitation coil 301 is connected to a relay excitation circuit provided in the controller 6. As shown in FIG. 5, relay control means 15 is provided in the controller 6, and when a mode selection switch SW1 is turned on to switch a control mode to a power generation mode, the relay control means 15 passes an excitation current from the relay excitation circuit to the excitation coil 301 of the electromagnetic relay 3' to turn on the contacts 3*u* and 3*w*. When the mode selection switch SW1 is turned off to switch the control mode to a vehicle driving mode, the relay control means 15 stops supply of the excitation current to the excitation coil of the electromagnetic relay 3' to open the contacts 3*u* to 3*w*.

Figure 5:
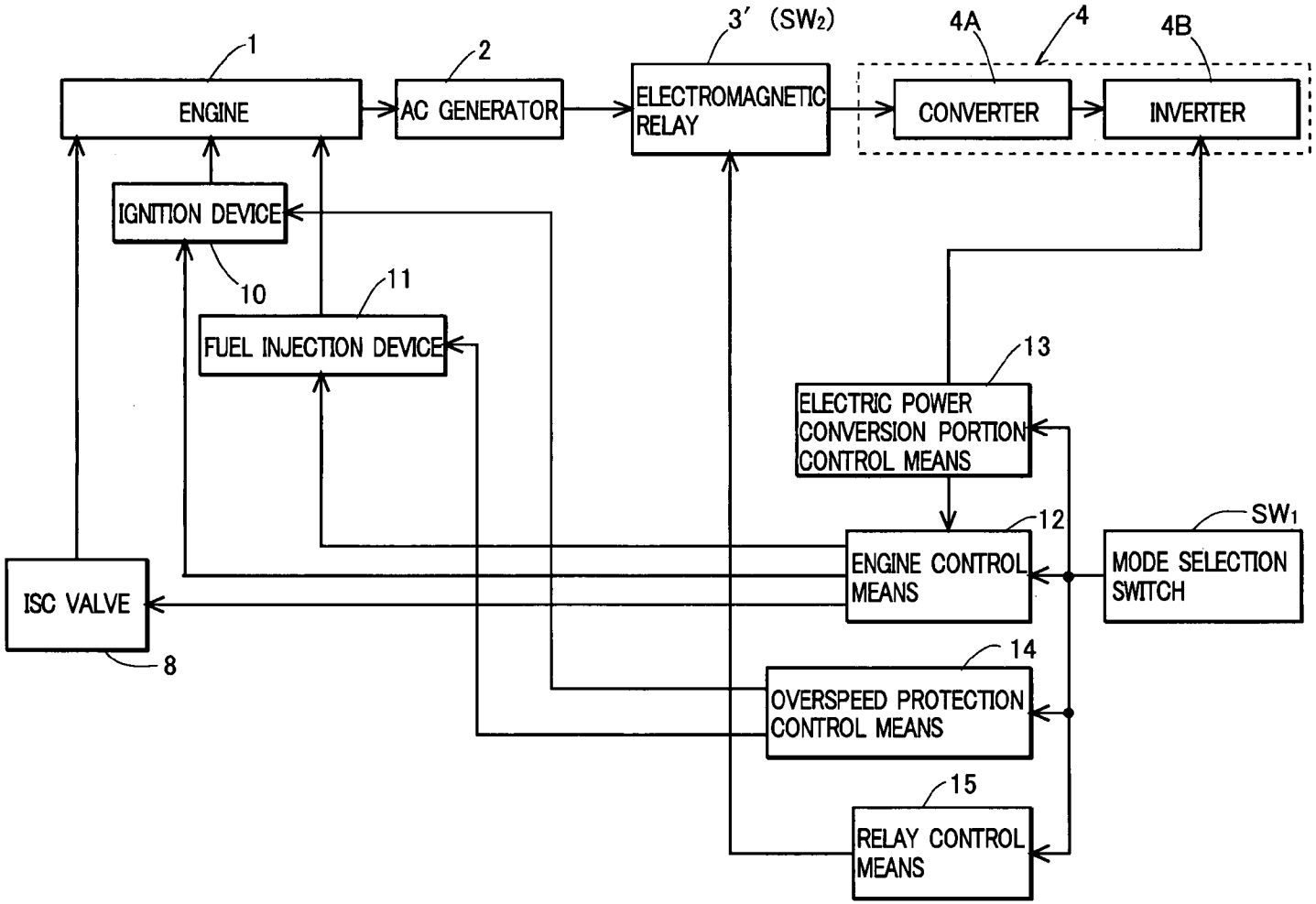
FIG. 5 is a block diagram of an example of an electrical construction of a power generator set including control means comprised by a microprocessor of a controller in the embodiment in FIG. 4.

Also in the example in FIG. 5, the controller includes overspeed protection control means 14 for controlling to stop at least either an ignition operation of an engine or supply of fuel to the engine when a rotational speed of the engine 1 exceeds a predetermined set speed with the control mode being switched to the power generation mode to limit the rotational speed of the engine to the set speed or less in order to prevent an overvoltage from being applied from the AC generator 2 to the electric power conversion portion 4. Providing the overspeed protection control means 14 prevents the overvoltage from being applied from the generator 2 to the electric power conversion portion 4 when a driver inadvertently operates an accelerator or when a load of a power generator set is suddenly reduced while the engine is operated in the power generation mode.

Figure 6:
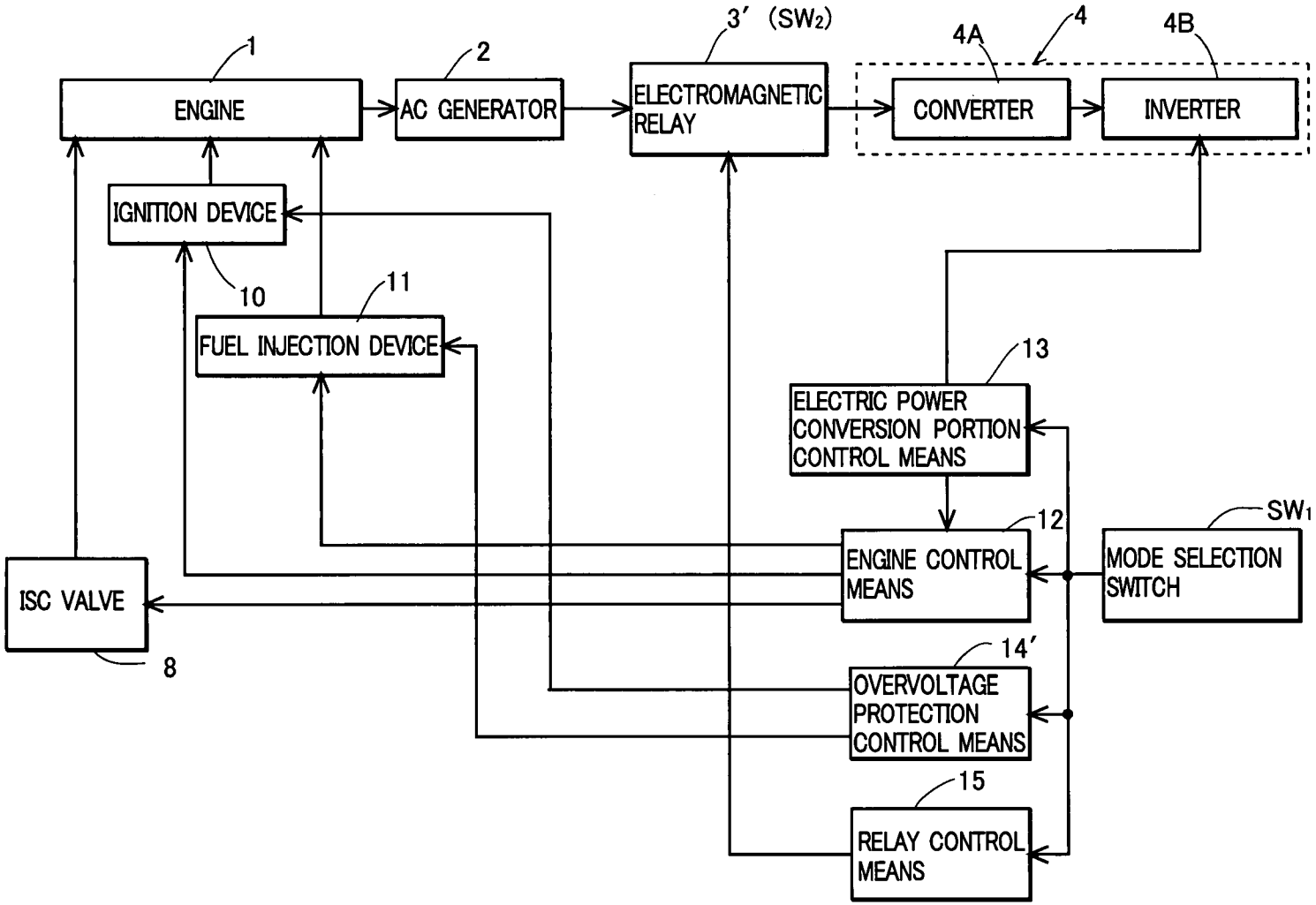
FIG. 6 is a block diagram of another example of an electrical construction of a power generator set including control means comprised by the microprocessor of the controller in the embodiment in FIG. 4.

Also in the case where the power generation output supply control switch is comprised of the electromagnetic relay, as shown in FIG. 6, instead of the overspeed protection control means 14, overvoltage protection control means 14' may be provided for controlling to stop at least either the ignition operation of the engine or the supply of the fuel to the engine when an output voltage of the AC generator 2 exceeds a predetermined set voltage with the control mode being switched to the power generation mode to limit the output voltage of the AC generator to the set voltage or less.

In the case where the power generation output supply control switch SW2 is comprised of the electromagnetic relay, as shown in FIG. 4, instead of the overspeed protection control means 14 in FIG. 5, overvoltage protection relay control means may be provided in the controller for controlling to open the contacts of the electromagnetic relay 3' when the rotational speed of the engine 1 exceeds the predetermined set speed with the control mode being switched to the power generation mode in order to prevent the overvoltage from being applied from the AC generator 2 to the electric power conversion portion 4.

Comprised as described above, when the driver operates the accelerator to increase the rotational speed of the engine while the engine is operated in the power generation mode, the electromagnetic relay can be deenergized to open the contacts 3*u* to 3*w* (the power generation output supply control switch SW2), thereby preventing the overvoltage from being applied from the generator to the electric power conversion portion 4.

Instead of the overvoltage protection control means 14' in FIG. 6, overvoltage protection relay control means may be provided in the controller for controlling to open the contacts of the electromagnetic relay 3' when the output voltage of the generator exceeds the predetermined set voltage with the control mode being switched to the power generation mode.

In the embodiment in FIG. 1, the contact 3*a* that constitutes the mode selection switch is turned on/off at the same phase as those of the contacts 3*u* to 3*w* that constitute the power generation output supply control switch SW2, but the mode selection switch may be a switch that is in different states between when the control mode is the power generation mode and the control mode is the vehicle driving mode, and thus the contact 3*a* may be turned on/off at a phase opposite to those of the contacts 3*u* to 3*w*. Specifically, the contact 3*a* is turned off and the contacts 3*u* to 3*w* are turned on when the control mode is the power generation mode, and the contact 3*a* is turned on and the contacts 3*u* to 3*w* are turned off when the control mode is the vehicle driving mode.

In the above embodiment, the ISC valve is controlled to control the rotational speed of the engine in the power generation mode. However, when a mechanism for adjusting a fully-closed position of the throttle valve (adjusting an opening degree when the throttle valve is fully closed) is provided, the mechanism for adjusting the fully-closed position of the throttle valve is controlled to control the opening degree of the throttle valve when fully closed and thus control the rotational speed of the engine in the power generation mode.

In the above embodiment, the mode selection signal input terminal 6*a* of the controller is grounded or not grounded to provide a mode selection signal to the controller, but a voltage signal may be provided from a constant voltage power supply circuit to the controller via the mode selection switch SW1 or removed to provide a mode selection signal to the controller.

In the embodiments in FIGS. 1 and 4, the electric power conversion portion 4 is comprised of the converter 4A and the inverter 4B, but the electric power conversion portion 4 may be comprised of a cyclone converter.

Although some preferred embodiments of the invention have been described and illustrated with reference to the accompanying drawings, it will be understood by those skilled in the art that they are by way of example, and that various changes and modifications may be made without departing from the spirit and scope of the invention, which is defined only to the appended claims.

What is claimed is:

1. A vehicle-mounted power generator set comprising:

an AC generator mounted in a vehicle and driven by an engine which drives the vehicle;

an electric power conversion portion that converts an output of said AC generator into an AC output having commercial frequency;

a mode selection switch that is operated to be in different states between when a control mode is a power generation mode and when the control mode is a vehicle driving mode;

a controller having electric power conversion portion control means for controlling said electric power conversion portion to generate an AC output having a fixed frequency from said electric power conversion portion when said control mode is the power generation mode, and engine control means for controlling said engine to rotate at a rotational speed suitable for supplying electric power from said electric power conversion portion to a load when said control mode is the power generation mode and controlling said engine to be suitable for driving of said vehicle when the control mode is the vehicle driving mode; and a power generation output supply control switch that is inserted between each output terminal of said AC generator and each input terminal of said electric power conversion portion, and controlled to be turned on/off in synchronization with said mode selection switch so as to be in an ON state when said control mode is the power generation mode and in an OFF state when said control mode is the vehicle driving mode.

2. The vehicle-mounted power generator set according to claim 1, wherein said controller comprises overspeed protection control means for controlling to stop at least either an ignition operation of said engine or supply of fuel to said engine when the rotational speed of said engine exceeds a predetermined set speed with the control mode being switched to the power generation mode to limit the rotational speed of said engine to said set speed or less in order to prevent an overvoltage from being applied from said AC generator to said electric power conversion portion.

3. The vehicle-mounted power generator set according to claim 1, wherein said controller comprises overvoltage protection control means for controlling to stop at least either an ignition operation of said engine or supply of fuel to said engine when an output voltage of said AC generator exceeds a predetermined set voltage with the control mode being switched to the power generation mode to reduce the rotational speed of said engine and limit the output voltage of said AC generator to said set voltage or less in order to prevent an overvoltage from being applied from said AC generator to said electric power conversion portion.

4. A vehicle-mounted power generator set comprising:

an AC generator mounted in a vehicle and driven by an engine which drives the vehicle;

an electric power conversion portion that converts an output of said AC generator into an AC output having commercial frequency;

a mode selection switch that is operated to be in different states between when a control mode is a power generation mode and when the control mode is a vehicle driving mode;

a controller having electric power conversion portion control means for controlling said electric power conversion portion to generate an AC output having a fixed frequency from said electric power conversion portion when said control mode is the power generation mode, and engine control means for controlling said engine to rotate at a rotational speed suitable for supplying electric power from said electric power conversion portion to a load when said control mode is the power generation mode and controlling said engine to be suitable for driving of said vehicle when the control mode is the vehicle driving mode; and an electromagnetic relay having a contact inserted between each output terminal of said AC generator and each input terminal of said electric power conversion portion, wherein said controller comprises relay control means for controlling said electromagnetic relay according to the state of said mode selection switch so that each contact of said electromagnetic relay is in an ON state when said control modes is the power generation mode and in an OFF state when said control mode is the vehicle driving mode.

5. The vehicle-mounted power generator set according to claim 4, wherein said controller comprises overvoltage protection relay control means for controlling to open the contact of said electromagnetic relay when the rotational speed of said engine exceeds a predetermined set speed with the control mode being switched to the power generation mode in order to prevent an overvoltage from being applied from said AC generator to said electric power conversion portion.

6. The vehicle-mounted power generator set according to claim 4, wherein said controller comprises overvoltage protection relay control means for controlling to open the contact of said electromagnetic relay when an output voltage of said generator exceeds a predetermined set voltage with the control mode being switched to the power generation mode in order to prevent an overvoltage from being applied from said AC generator to said electric power conversion portion.

7. The vehicle-mounted power generator set according to claim 4, wherein said controller comprises overspeed protection control means for controlling to stop at least either an ignition operation of said engine or supply of fuel to said engine when the rotational speed of said engine exceeds a predetermined set speed with the control mode being switched to the power generation mode to limit the rotational speed of said engine to said set speed or less in order to prevent an overvoltage from being applied from said AC generator to said electric power conversion portion.

8. The vehicle-mounted power generator set according to claim 4, wherein said controller comprises overvoltage protection control means for controlling to stop at least either an ignition operation of said engine or supply of fuel to said engine when an output voltage of said AC generator exceeds a predetermined set voltage with the control mode being switched to the power generation mode to reduce the rotational speed of said engine and limit an output voltage of said AC generator to said set voltage or less in order to prevent an overvoltage from being applied from said AC generator to said electric power conversion portion.

* * * * *